US005579607A

United States Patent [19]

Braid

[11] Patent Number: 5,579,607

[45] Date of Patent: Dec. 3, 1996

[54] CONVENIENT AUTOMATIC CLOSING SYSTEM FOR DOORS

[76] Inventor: Dennis G. Braid, 30035 Grandiflores, Canyon Country, Calif. 91351

[21] Appl. No.: 341,016

[22] Filed: Nov. 17, 1994

[51] Int. Cl.[6] ..... E05D 15/06

[52] U.S. Cl. ..... 49/404; 16/81; E05D/15/06

[58] Field of Search ..... 49/404; 16/49, 16/51, 58, 71, 81, 82, 84

[56] References Cited

U.S. PATENT DOCUMENTS

| | | | |
|---|---|---|---|
| 3,334,444 | 8/1967 | Hargrove | 49/404 |
| 4,003,102 | 1/1977 | Hawks et al. | 16/81 X |
| 4,126,912 | 11/1978 | Johnson . | |
| 4,649,598 | 3/1987 | Kinsey et al. . | |
| 4,665,584 | 5/1987 | Williams . | |
| 4,884,369 | 12/1989 | Tathham . | |
| 4,891,911 | 1/1990 | Yung . | |
| 5,285,596 | 2/1994 | Kinsey | 16/81 X |

*Primary Examiner*—Jerry Redman
*Attorney, Agent, or Firm*—Poms, Smih, Lande & Rose

[57] ABSTRACT

A housing having a first cross-sectional shape includes an elongate passageway disposed between a sealed bottom end of the housing and a top opening thereof. Liquid is disposed in the elongate passageway. A pulley is mounted substantially above the top opening. A weight adapted to fit in the housing has a second cross-sectional shape that differs substantially from the first cross-sectional shape. A cable having a first end and a second end is entrained on the pulley, and a valve member is movably mounted with respect to the weight for directionally regulating a damping force associated with the movement of the weight through the liquid. The cable is attached to the weight at the first end of the cable. One of the housing and the second end of the cable is attached at a fixed location with respect to the door and the other of the housing and the second end of the cable is attached to the door. The weight moves upwardly through the liquid in the elongate opening with a first damping force in response to an opening movement of the door and the weight moves downwardly through the liquid in the elongate opening with a second damping force when the door is released thereby controlling the automatic closing of the door. Two molded plastic parts from a plug for the top end of the passageway and include cylindrical mounting surfaces for the pulley.

20 Claims, 3 Drawing Sheets

CONVENIENT AUTOMATIC CLOSING SYSTEM FOR DOORS

BACKGROUND OF THE INVENTION

1. Field of the Invention

This invention relates to a system for regulating the movement of a door, and more particularly, to a system for automatically and controllably closing a sliding door.

2. Description of the Prior Art

Many contemporary homes include sliding glass doors. For the sake of convenience and energy conservation, it is desirable to provide sliding doors with the ability to close automatically. Although several devices have been proposed for automatically closing sliding doors, such devices have failed to provide an inexpensive, easily installed system or kit for controllably closing a sliding door in a relatively slow manner and for maintaining the ease and ability of a person to open the sliding doors unhindered.

For example, U.S. Pat. No. 4,649,598, issued to Kinsey, et al., discloses a door closer with a sliding door. Kinsey includes a long cylindrical housing attached to one vertical edge of the sliding door, a weight in the cylinder and a cable connecting the weight over a pulley in the top of the cylinder to an anchor in the door jam. A seal surrounds the weight so that there is a sealing contact with the housing to form a pneumatic cylinder therein. The lower part of the cylinder is provided with passageways which let air go in or out of the cylinder. The upper part of the weight is provided with a valve which is always biased to the open position but is held closed so long as the cable is taut. When the cable is loose, the valve opens and air can rush out and the door will close faster. As illustrated clearly in FIGS. 3 and 11, Kinsey requires a rather complicated spring-biased pneumatic valve in addition of other fairly complex components, which are relatively expensive and may become unreliable during extended use.

Similarly, U.S. Pat. No. 4,126,912 issued to Johnson, discloses a kit of components readily attachable to a sliding door without modification of the door to effect gravity actuated closing. Johnson discloses a guide channel and pulley that are simply adhesively secured on outwardly facing surface portion of door at the rear of the door. A weight is slidably confined within the guide and hangs from a line entrained over the pulley and connected to a hook on the doorway lintel. The kit includes a universal wheel and bracket assembly that can be readily mounted on many different types of doors. Johnson does not appear to disclose any means of damping, regulating, or controlling the rate associated with the automatic closing of the sliding door. Johnson also appears to require the use of anti-friction devices to minimize door friction and provide optimum operation.

Another reference showing an automatic door or window closing device is U.S. Pat. No. 4,884,369 issued to Tatham. Tatham includes a tube attached to the edge of a movable door or window. The tube has a weight displaced therein with a cable attached at the top which passes out of the top of the tube across a pulley and is connected to the door or window jam. A pneumatic seal is provided between the weight and the inside wall of the tube and works in conjunction with the port and valve at the bottom of the tube for controlling the flow of air passing there- through. When the door or window is opened, the weight rises in the tube. When the door or window is released, the weight drops in the tube according to the adjustment of the port and the valve at the bottom of the tube until the door or window is completely closed. Tatham requires a pneumatic seal between the weight and the tube used in conjunction with a relatively complicated port means below the weight. This arrangement appears to be relatively complicated, precise, expensive, and unreliable.

Another reference disclosing a door closing device is U.S. Pat. No. 4,665,584 issued to Williams. Williams describes a device having an upright tube closed at the bottom and containing a damping liquid with a sinker weight being arranged in the tube and connected to a flexible cord which extends out of the top of the tube for connection to a door so that a door is automatically closed when released, the sinker weight falling under gravity to pull the door closed. The device includes a passage extending through the sinker weight with a valve seat formed at the lower end of the passage and cooperating with a self-seating valve member (preferably a plastic ball which is not captive relative to the weight) which controls liquid flow through the passage when the weights sinks. As the door is opened, the weight is pulled rapidly upwards and lifts off the buoyant valve member. Preferably, the valve member substantially seals the passage in the weight and there is a clearance around the weight for passage of the damping liquid during closing of the door. A difficulty of Williams is that it relies upon the clearance fit between the weight and the tube to provide uniform damping of the closing door motion, since the loading valve member substantially seals the passage in the weight when the weight sinks. Thus, the Williams device appears to be difficult to adapt for use in the a variety of door closing applications. Also, the casting of the weight is more complicated since it must provide for the formation of a bore hole through the weight and of a relatively precise valve seat for receiving the buoyant valve member.

U.S. Pat. No. 4,891,911, issued to Young describes an automatic door closing device comprising an elongated tubular member containing a counter weight that maintains an airtight seal as it moves up and down within the tubular member. A flexible cable attached at one end to the counter weight is anchored at its opposite end to an upper track member at a pre-selected location. An upper end element fits into the tubular member and has a pulley wheel for supporting the cable between its ends. A lower end element that fits into the lower end of the tubular member forms an airtight seal for a variable chamber below the counter weight. This lower end element has a check valve for allowing outside air to flow into the chamber while preventing air from flowing out of the chamber and it also supports a separate, adjustable bleed valve for allowing air to flow out of the chamber at a restricted rate so as to control the downward travel of the cable within the tubular member when the door is closing. Hence, Young also requires relatively complicated, expensive, and unreliable pneumatic components.

The foregoing limitations and difficulties in the art generally indicate that it would be desirable to provide an inexpensive, simple, reliable, easily installed system or kit for automatically closing a door in a controlled manner while also maintaining the ease and ability of opening the door in a substantially unhindered fashion.

SUMMARY OF THE INVENTION

Accordingly, in one broad aspect embodying principles of the present invention, there is provided an inexpensive, reliable, easily installed system or kit for automatically closing a door in a controlled manner while also maintaining the ease and ability of opening the door in a substantially unhindered fashion.

The system for regulating the movement of a door comprises a housing having a first cross-sectional shape and including an elongate passageway disposed between a sealed bottom end of the housing and a top opening thereof; liquid disposed in the elongate passageway or opening; a pulley mounted substantially above the top opening; a weight adapted to fit in the housing having a second cross-sectional shape that differs substantially from the first cross-sectional shape; a cable having a first end and a second end, entrained on the pulley; and a valve connected to the weight for directionally regulating a damping force associated with the movement of the weight through the liquid. The cable is attached to the weight at the first end of the cable. To couple the biasing force of the weight to close the door, the housing is preferably mounted on the door, and the second end of the cable is secured to a fixed location relative to the door; but the housing may be fixed and the second end of the cable may be secured to the door. The weight moves upwardly through the liquid in the elongate opening with a first, relatively low damping force in response to an opening movement of the door. The weight moves downwardly through the liquid in the elongate opening with a second damping force when the door is released, thereby controlling the automatic closing of the door.

In accordance with a specific embodiment illustrating the principles of the present invention, a system is provided for regulating the movement of a door, comprising: a housing having a substantially square cross-sectionally shaped inner surface and including an elongate opening therein disposed between a bottom opening of the housing and a top opening of the housing; a plug disposed in the bottom opening providing a water-tight seal at the bottom of the elongate opening; a liquid disposed in the elongate opening; a cap having an exit hole therein disposed in the top opening of the housing; a pulley having a groove therein rotatably mounted in the cap, the groove substantially aligned with the exit hole; a cylindrically shaped weight disposed within the square cross-section of the elongate opening and movable upwardly and downwardly through the liquid within the elongate opening; a cord or other flexible tension line having a first end and a second end, the cord entrained in the pulley groove and running through the exit hole in the cap, the second end of the cord disposed outside the cap and the first end of the cord disposed inside the elongate opening below the cap; a securing means for attaching the first end of the cord to the top of the weight within the housing; a valve having a substantially square cross-sectional shape providing a predetermined tolerance fit between an outer surface of the valve and the inner surface of the housing, the valve also having a plurality of openings disposed concentrically from the center of the square cross-sectional shape and a mounting hole substantially centered in the square cross-section; and a shaft having a predetermined length passing through the valve mounting hole and attached to the bottom of the weight, including a stop surface at one end thereof for halting the translational motion of the valve along the shaft when the weight moves upwardly through the liquid.

As noted above, one of the housing and the second end of the cable is attached at a fixed location with respect to the door and the other of the housing and the second end of the cable is attached to the door. The weight moves upwardly through the liquid in the elongate opening with a first damping force in response to an opening movement of the door. The weight moves downwardly through the liquid in the elongate opening with a different damping force when the door is released thereby controlling the automatic closing of the door.

In accordance with one feature of the invention, the cap and pulley mounting assembly for the top of the elongated opening is simply formed of two mating parts which have opposed cylindrical recesses for mounting the pulley, and an outer configuration which matches the inner configuration of the elongated opening, fluid channel or passageway, along with a shoulder so that the two mating parts are held together at the top of the channel. The pulley element has a central groove for guiding the tension line and an axially extending cylindrical mounting extension or axle member for fitting into the cylindrical recesses in the two mating parts.

These and other objects, features and advantages of the present invention will now become apparent from a review of the drawings and the following description of the preferred embodiment.

DETAILED DESCRIPTION OF THE PREFERRED EMBODIMENT

Figure 1:
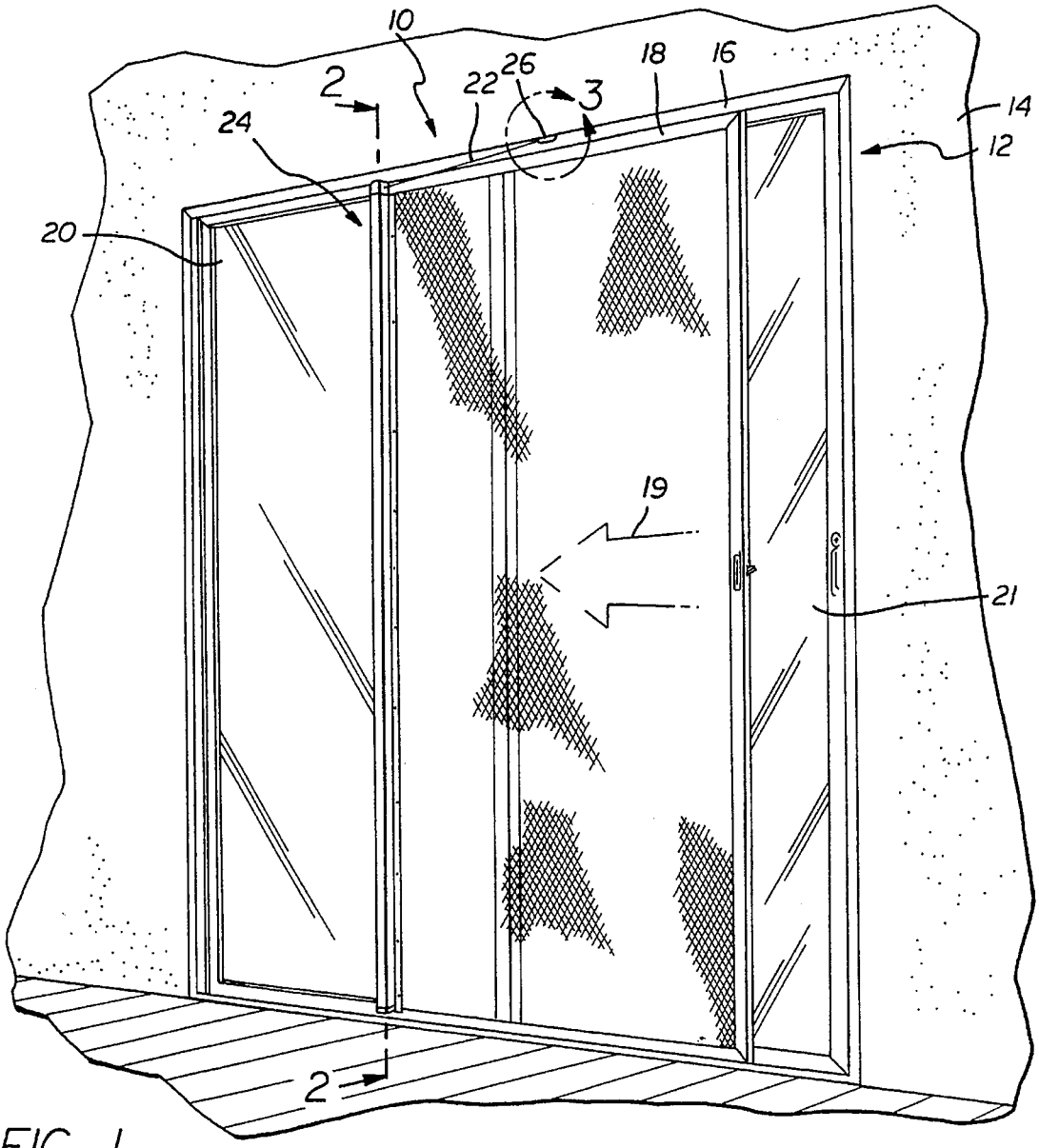
FIG. 1 illustrates a convenient automatic door closing system, embodying principles of the present invention, operatively mounted on a sliding screen door.

As illustrated in FIG. 1, a simple, inexpensive door control system 10 embodying principles of the present invention is used to control the opening and automatic closing of a sliding screen door 18. The sliding door assembly 12 preferably comprises, in conventional fashion, a frame 16 mounted in wall 14 for mounting sliding door panel 17, fixed window panel 20, and sliding screen door 18.

The present door control system 10 preferably comprises control assembly or housing assembly 24 vertically mounted to sliding screen door 18, and cable 22 exiting the top of assembly 24 and being attached to a fixed location 26 such as door frame 16 or wall 14.

Figure 2:
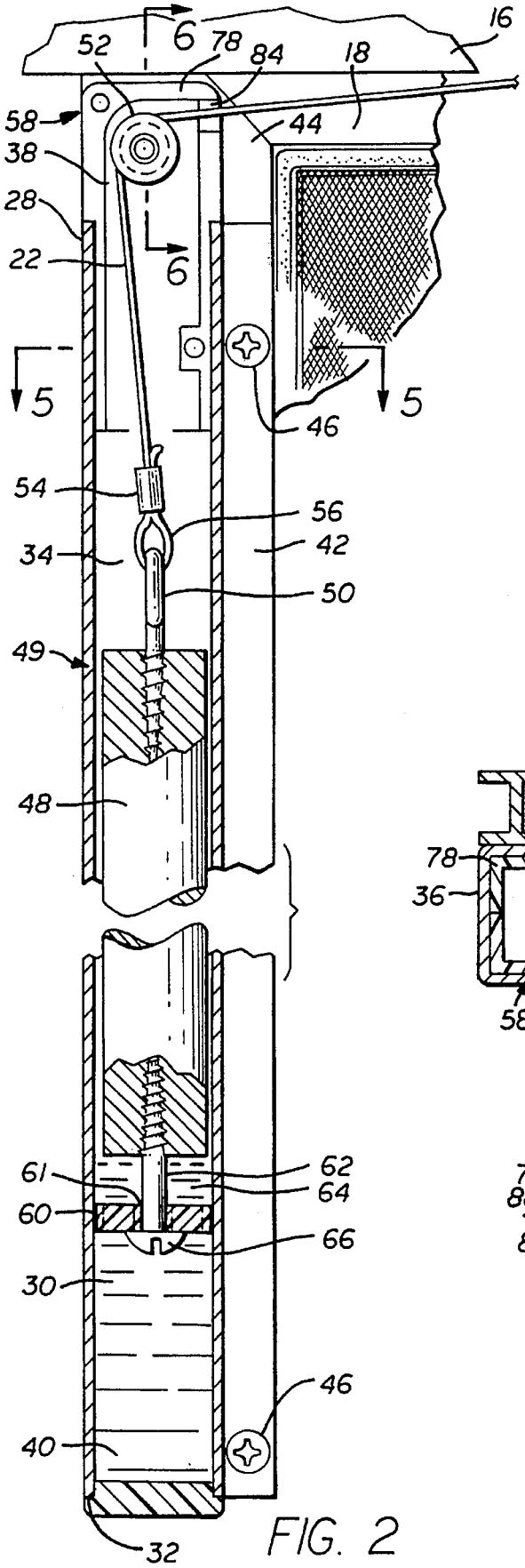
FIG. 2 illustrates, in sectional view, details of a housing assembly included in the door closing system of FIG. 1.
Figure 5:
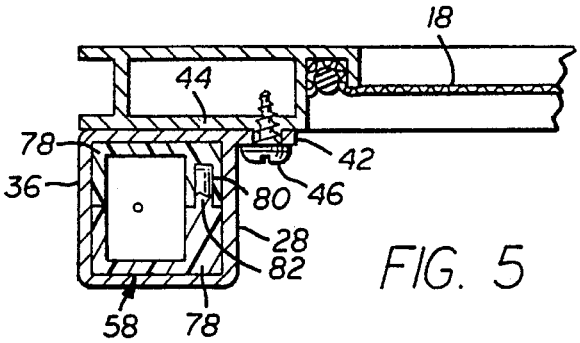
FIG. 5 illustrates a sectional view of the housing assembly shown in FIG. 1 taken along the sectional lines 5—5 thereof.
Figure 10:
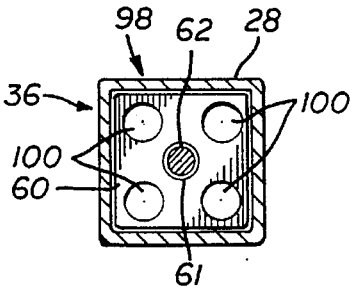
FIG. 10 illustrates, in sectional view taken along the lines 10—10 of FIG. 9, that openings through the valve remain substantially unblocked in the first position.
Figure 12:
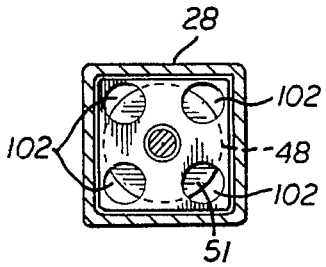
FIG. 12 illustrates, in sectional view along the lines 12—12 of FIG. 11, that the openings through the valve remain partially unblocked but are partially blocked in the second position, as the weight moves more slowly downward.

As illustrated in the partial cross-sectional view of FIG. 2, the door control assembly 24 preferably comprises several simple and inexpensive parts. A tube, sleeve, or housing 28 preferably comprises plastic, metal (such as aluminum) or other durable material. Housing 28 preferably includes an elongate hollow region or elongate opening 34 disposed within the walls of the housing 28. Housing 28 has a geometric cross-section which can be square, rectangular, circular, or have any other desired shape. Preferably, the cross-section 36 of housing 28 is substantially square in shape as best illustrated in FIGS. 10 and 12. Housing 28 preferably includes a top opening 38 and a bottom opening 40. A seal or plug 32 is preferably permanently secured into bottom opening 40 of housing 28 to seal off the bottom end of the housing 28. A mounting flange or mounting portion 42 is preferably provided as an integral part of housing 28, as best illustrated in FIG. 5.

The housing assembly 24 is preferably secured to the sliding screen door 18 by mounting screws 46 inserted through holes 47 in the mounting flange 42. The mounting screws 46 are securely threaded into vertical frame member 44 of the sliding door 18 as best shown in FIGS. 2 and 5. Referring to FIG. 2, the seal or plug 32 preferably comprises plastic, rubber, or the like for providing a substantially water-tight fit into the bottom opening 40 of housing 28. The housing 28 is filled with a liquid or other viscous fluid 30, such as water or light grade oil, thus providing a damping medium in the elongate opening 34. The water may be provided with antifreeze such as ethylene glycol.

A weight 48 is provided to move upwardly and downwardly within the confines of the elongate opening 34 of the housing 28. The weight 48 preferably comprises lead, or similar relatively dense material, and is preferably formed in a simple casting mold. The weight is suspended from a cable 22 preferably attached to the top of the weight 48 using a closed eye screw 50 threaded into the top of the weight 48. A loop 56 of cable 22 engages the annulus of closed eye screw 50. A clamp 54 may be used to crimp or secure two portions of cable 22 in order to provide loop 56. The cable 22 is entrained over a pulley 52 and is attached at a fixed location 26 (see FIGS. 1, 3 and 8) at the opposite end of cable or tension line 22.

The pulley 52 is supported at the top of the elongate opening or passageway 34 of the housing 28 by a positioning cap 58. The positioning cap 58 is inserted into the top opening 38 of the housing 28, and is adapted to hold the pulley 52 securely in place at the top of the housing 28. Hence, weight 48 is supported by cable 22 which extends over pulley 52.

A ported member or simple valve 60 is preferably attached to the bottom of weight 48 using a screw 62 threaded into the bottom of weight 48. The valve mounting screw 62 includes a shaft portion 64 extending below the weight 48 for a predetermined length until the screw 62 terminates at a stop surface, stop portion, or head 66 thereof. The valve member 60 preferably comprises an apertured square plate of plastic or similar suitable material.

Figure 9:
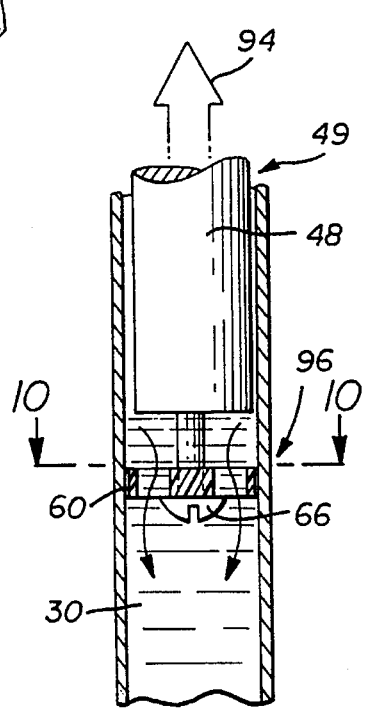
FIG. 9 illustrates, in partial sectional view, a valve attached to the weight and disposed in a first position against a stop portion of a shaft as the weight moves upwardly.
Figure 11:
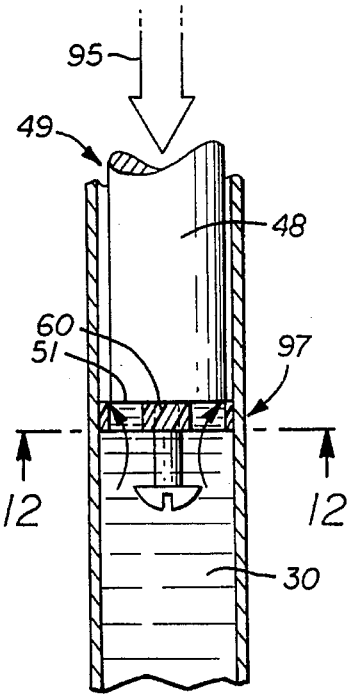
FIG. 11 illustrates, in partial sectional view, the valve attached to the weight disposed in a second position against the weight as the weight moves downwardly.

The valve member 60 is slidably mounted to the shaft 64 using a hole 61 provided in the valve 60. The valve 60 slides upwardly or downwardly along the shaft portion 64 in response to an upward or downward motion of the weight 48 through the fluid 30. During an upward motion 94 of the weight 48, as illustrated in FIG. 9, the valve 60 comes to rest in a first position 96 against the head 66 of the valve mounting screw 62. During a downward motion 95 of the weight 48, as illustrated in FIG. 11, the valve 60 comes to rest in a second position 97 against the bottom surface 51 of the weight 48.

Figure 3:
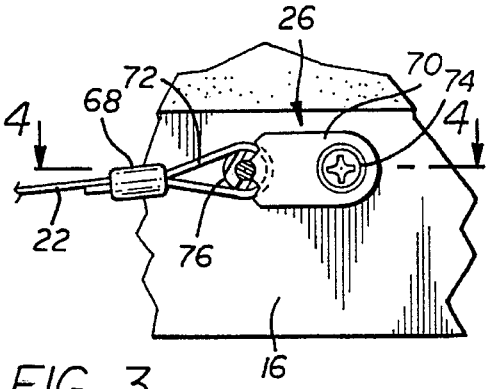
FIG. 3 illustrates details of attaching a cable at a fixed location as used in the door closing system of FIG. 1.
Figure 4:
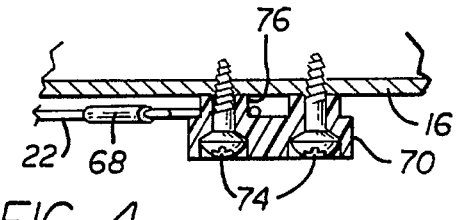
FIG. 4 illustrates a sectional view of the details illustrated in FIG. 3 taken along section lines 4—4.

As illustrated in FIG. 3, a second or remote end of cable 22 is secured at fixed location 26 using mounting bracket 70. Mounting bracket 70 includes a pin portion 76 for engaging a loop 72 formed substantially at the end of cable 22. The loop 72 may be provided by folding over an end of cable 22 onto a nearby portion thereof and engaging the two portions of cable 22 by clamp 68. The mounting bracket 70 preferably includes two holes for accepting the shaft of two screws 74. The screws 74 are preferably threaded through each hole in the mounting bracket 70 and through a frame portion 16 of the sliding door assembly 12.

Figure 8:
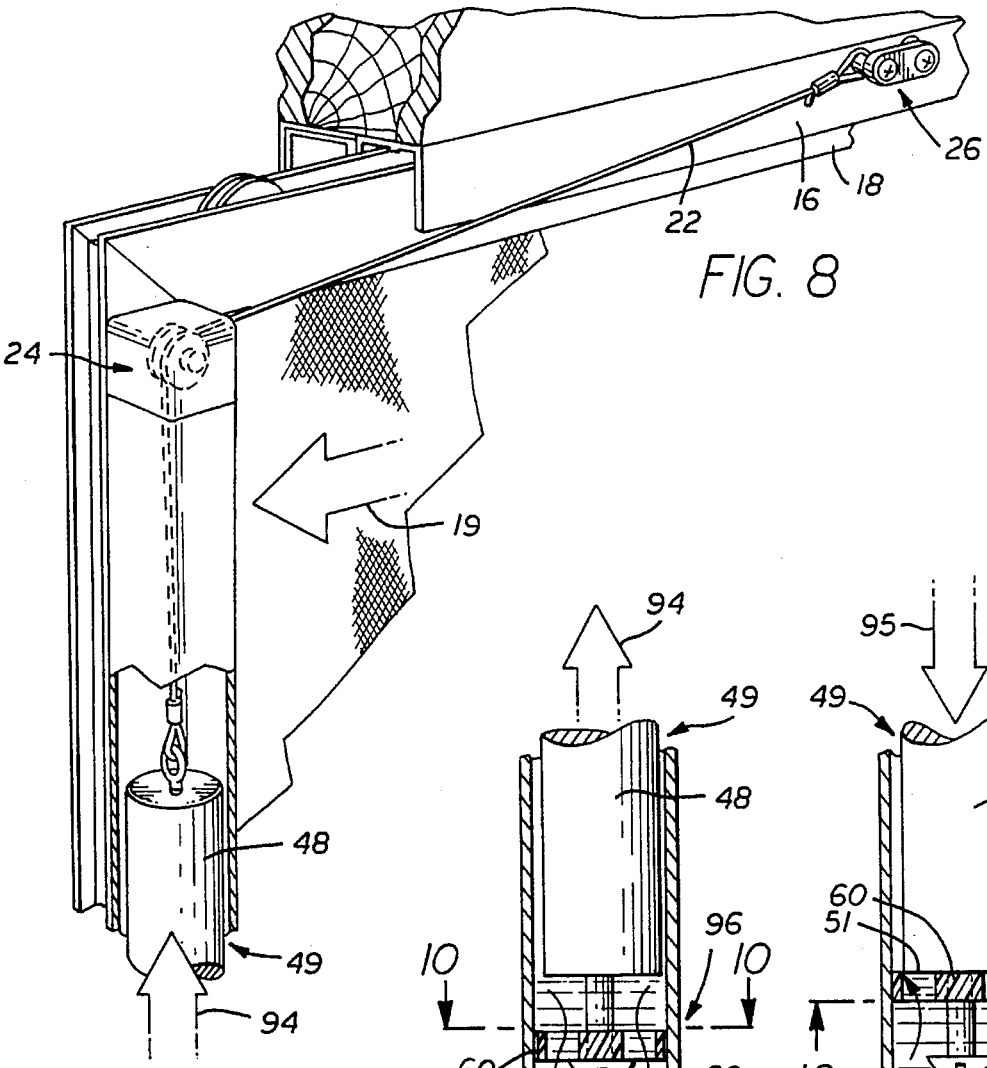
FIG. 8 illustrates, in partial sectional view, the upward movement of a weight within the housing assembly when a door is opened.

FIGS. 1 and 8 illustrate the preferred positioning of fixed location 26 relative to the housing 28. Cable or tension line 22 is preferably provided with a length just slightly in excess of the range of motion of weight assembly 49 in housing 28. The outer or second end 72 of cable 22 is preferably secured at fixed location 26 substantially near the top of housing 28 when the sliding door panel 18 is in the closed position and the housing 28 is attached thereto.

If the sliding door 18 opens to the left, as illustrated in FIGS. 1 and 8, then the fixed location 26 is provided just to the right of the top of housing 28, when the sliding screen door is closed. If the sliding door 18 opens to the right, (not shown) then the fixed location 26 is positioned just to the left of the top of housing 28. Alternatively, the second end 72 of cable 22 can be attached to the sliding door 18 and the housing 28 can be attached at a nearby fixed location (not shown).

Figure 7:
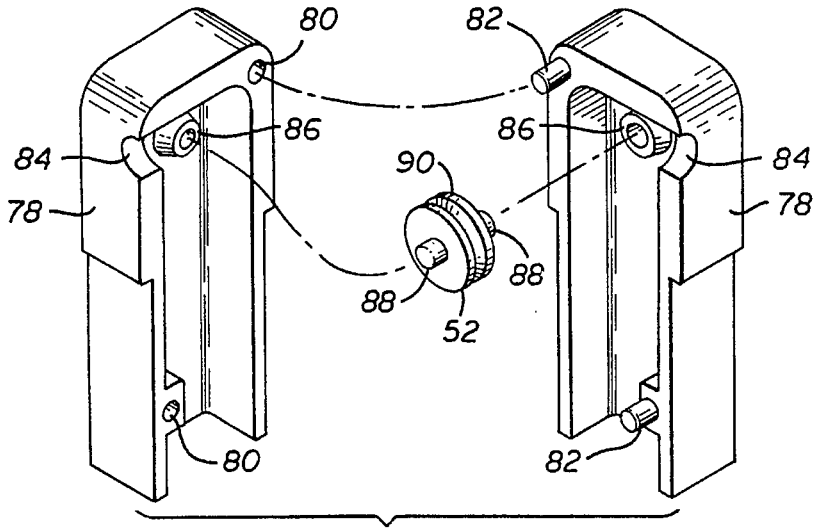
FIG. 7 illustrates, in exploded view, a cap and pulley assembly included as part of the housing assembly.

FIG. 5 is a cross-sectional view taken through the top of housing 28 and the lower portion of cap 58. Mounting screw 46 engages and secures mounting flange 42 of housing 28 to upright member 44 of sliding door 18. Also with reference to FIG. 7, on sheet 1 of the drawings, positioning cap 58 preferably includes two molded portions 78 which are fitted together prior to insertion into the top opening 38 of housing 28. One or more assembly pins 82 are preferably provided in one of cap portions 78 and corresponding pin holes or recesses 80 are provided in the other cap portion 78. The pins 82 are inserted into holes 80 when the cap 58 is assembled.

Figure 6:
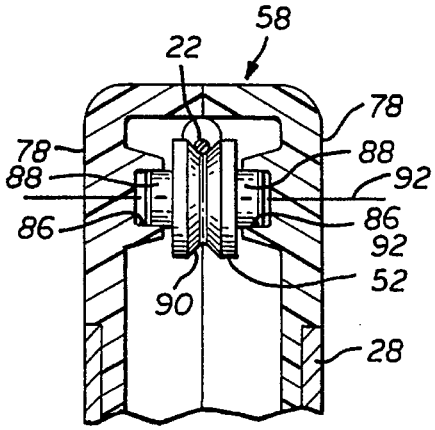
FIG. 6 illustrates a sectional view of the housing assembly shown in FIGS. 1 and 2 taken along the sectional lined 6—6 of FIG. 2.

FIG. 6 is a sectional view of the cap 58 illustrating the pulley 52 being rotationally mounted on bearing surfaces 86 provided on the inside walls of cap portions 78. The cap portions 78 and pulley 52 are preferably each molded as a single piece of plastic material. Pulley 52 preferably includes axle portions 88 disposed on opposing sides of a groove 90 provided therein. Each axle portion 88 engages a respective bearing surface 86 thereby supporting the pulley 52 in the cap 58 and allowing the pulley to rotate about a horizontal axis 92.

Cable 22 is entrained in the groove 90 of pulley 52. A silicone, oil-based, or other suitable lubricant may be provided on the surfaces where the axle portions 88 contact the bearing surfaces 86. A hole 84 is provided in the cap 58 substantially in alignment with the top of groove 90 of the pulley 52. The cable 22 exits the cap 58 through the hole 84.

As illustrated in FIG. 8, an opening motion 19 of the sliding door 18 creates a tension in cable 22 and raises the weight assembly 49 within the housing assembly 24. This results in an upward motion 94 of the weight assembly 49 within the housing assembly 24. As illustrated in FIGS. 8 and 9, the upward motion 94 of weight assembly 49 through liquid 30 leaves the valve member 60 engaged against the stop surface 66 of valve mounting screw 62, corresponding to a first or open position 96 permitting easy opening of the door.

As illustrated in FIG. 10, valve 60 has a geometric cross-sectional shape 98 which preferably corresponds to the geometric cross-sectional shape 36 of the housing 28. In particular, FIG. 10 illustrates a square cross-sectionally shaped housing 28 with a square cross-sectionally shaped valve 60 adapted to have a tolerance fit with the inner surface of housing 28. The tolerance fit between the valve 60 and the housing 28 is provided to be relatively close but is susceptible to a range of values. For example, a clearance between the edges of the valve 60 and the inner surface of the elongate opening 34 of approximately 1/64–1/32 inch is sufficient. Preferably, the tolerance fit is such that sliding friction between valve 60 and housing 28 is not appreciable and such that only relatively small amounts of liquid 30 can pass through the relatively small space provided therebetween when the weight assembly 49 is in motion.

Valve 60 preferably includes a plurality of circular openings, passages, or ports 100. Preferably, four circular passages 100 are disposed concentrically and symmetrically about the center point of the square cross-section of valve 60. The passages allow the liquid 30 to flow through the valve 60 as it moves directionally with the weight 48. When the valve 60 is disposed in the open position 96 as illustrated in FIG. 9, the passages 100 of the valve 60 remain substantially unblocked to the flow of fluid 30 through the passages 100. This allows the weight assembly 49 to be accelerated or moved upwardly in response to a door opening motion 19 while encountering only a relatively small magnitude first damping force in opposition to the upward movement.

Thus, a person is not hampered significantly by the door control system 10 while opening door 18. Significantly, the first damping force opposing the upwardly moving weight assembly 49 may be used to advantageously curb the tendency of door 18 to slam open or accelerate excessively in response to a relatively large impulse force applied to the door 18. The magnitude of the upward or first damping force can be predetermined by varying the features of one or more components of the housing assembly 24, such as the size of the valve passages 100.

Once sliding door 18 has been slightly opened, the release of the door 18 creates tension in cable 22 due to the gravitational force of the weight assembly 49 within the housing assembly 24. This downward motion 95 of the weight assembly 49 through the housing assembly 24 causes the door 18 to close automatically when released in an open position. As illustrated in FIG. 11, the downward motion 95 of weight assembly 49 through liquid 30 causes the valve member 60 to be engaged against the bottom surface 51 of weight 48, corresponding to a second or restricted position 97.

As illustrated in FIG. 12, the cylindrical weight 48 includes a bottom surface 51 having a substantially circular perimeter. The valve openings 100 are substantially circular having a respective center substantially aligned with the circular perimeter of bottom surface 51. The bottom surface 51 of the weight 48 halts the translational motion of the valve 60 along the shaft 64 when the weight 48 moves downwardly. This corresponds to the second position 97 of the valve 60, causing the partial blocking each of the valve openings 100 and providing a restricted opening area 102.

The restricted flow of liquid 30 through the restricted openings 102 provides a relatively large second damping force in opposition to the downward movement 97 of the weight 48. The relatively large magnitude second damping force controls the closing rate of the door 18, providing for a substantially uniform controlled and relatively slow closing speed.

Although the system may be fabricated using various materials and dimensions, one workable embodiment was made using an extruded aluminum channel with an extending flange, with the aluminum walls being about 1/16-inch thick, and the weight being formed of a cylindrical lead element about 1 and 13/16-inches in diameter and about 13 inches long. The value element was mounted on a screw and was formed of a square pill of plastic about 7/8-inch on a side and with a central hole for receiving the screw, and four spaced openings about 1/4-inch diameter overlapping the flat end of the lead weight, so that the openings are partially blocked when the valve element engages the lower end of the weight. The channel was filled with water and appropriate amounts of mineral oil, depending on local weather conditions. The channel was approximately 5½-feet long to accommodate the usual maximum opening of a sliding door such as a screen door which would be a foot or so less than the height of the channel. The tension line was formed of nylon coated cable.

The foregoing description illustrates principles embodying an inexpensive, simple, reliable, easily installed system or kit for automatically closing a door in a controlled manner while also maintaining the ease and ability of opening the door in a substantially unhindered fashion. Accordingly, the foregoing details can be modified without detracting from the principles embodying the present invention. For example, the door control system 10 may be used on virtually any type of door without loss of generality. The cross-sectional shape of the housing 28 may be provided as circular, rectangular, or some other shape. Similarly, the cross-sectional shape of the weight 48 may be changed. The cross-sectional shape of valve 60 may be modified as well. The size of the valve openings 100 may be adapted to provide larger or smaller magnitude damping forces, Some of the openings may remain unblocked and others fully blocked by the lower surface of the weight when the value member engages the lower end of the weight. These and other modifications would become evident from reading the foregoing description embodying principles of the present invention, Accordingly, the present invention should not be limited to the specific embodiments shown in the drawings and described in detail hereinabove.

What is claimed is:

1. A system regulating movement of a door, comprising:

a housing having a substantially square cross-sectionally shaped inner surface and including an elongate passageway therein disposed between a bottom opening of said housing and a top opening of said housing;

a plug disposed in said bottom opening providing a water-tight seal at the bottom of said elongate passageway;

liquid disposed in said elongate passageway;

a cap having an exit hole therein disposed in said top opening of said housing;

a pulley having a groove therein rotatably mounted in said cap, said groove substantially aligned with said exit hole;

a cylindrically shaped weight having a top and a bottom disposed within said square cross-section of said elongate passageway and movable upwardly and downwardly through said liquid within said elongate passageway;

a tension line having a first end and a second end, said tension line entrained in said pulley groove and running through said exit hole in said cap, said second end of said tension line disposed outside said cap and said first end of said tension line disposed inside said passageway opening below said cap;

a securing means for attaching said first end of said tension line to the top of said weight within said housing;

a valve member having a substantially square cross-sectional shape with a center providing a tolerance fit between an outer surface of said valve member and said inner surface of said housing, said valve member also having a plurality of openings disposed concentrically from the center of said square cross-sectional shape and a mounting hole substantially centered in said square cross-sectional shape, at least some of said openings being at least partially blocked by the bottom of said weight, where said value member engages said weight;

a shaft having a length passing through said valve mounting hole and attached to the bottom of said weight, including a stop surface at one end thereof for halting translational motion of said valve member along said shaft when said weight moves upwardly through said liquid; and one of said housing and said second end of said cable attached at a fixed location with respect to said door and the other of said housing and said second end of said cable attached to said door;

wherein said weight moves upwardly through said liquid in said elongate passageway with a first damping force in response to an opening movement of said door and said weight moves downwardly through said liquid in said elongate passageway with a different damping force when said door is released thereby controlling a rate at which said door automatically closes.

2. The system as defined in claim 1 in which:

said cylindrical weight includes a bottom surface having a substantially circular perimeter; and said valve openings are substantially circular and each having a respective center substantially aligned with said circular perimeter;

wherein said bottom surface of said weight halts translational motion of said valve member along said shaft when said weight moves downwardly thereby partially blocking each of said valve openings and providing a relatively large second damping force in opposition to said downward movement of said weight and thereby controlling the closing rate of said door.

3. The device as defined in claim 1 for use with a sliding door, further including housing securing means;

in which said housing is attached on said door by said securing means and said second end of said tension line is attached at a fixed location relative said door.

4. A system as defined in claim 1 for use with a sliding door, further including housing securing means;

in which said second end of said tension line is attached to said door and said housing is attached at a fixed location relative said door by said securing means.

5. A system as defined in claim 1 wherein said cap is formed of three plastic molded parts including two outer parts having a generally square outer cross-section for fitting down into said housing, and each of said parts having a cylindrical bearing surface for mounting said pulley which constitutes one of said three plastic molded parts.

6. A system regulating movement of a door, comprising:

a housing having a first cross-sectional shape and including an elongate passageway disposed between a sealed bottom end of the housing and a top opening thereof;

a liquid disposed in said elongate passageway;

a pulley mounted substantially above said top opening;

a weight adapted to fit in said housing having a second cross-sectional shape that differs substantially from said first cross-sectional shape;

a cable having a first end and a second end, entrained on said pulley;

a valve member mounted to said weight for movement toward and away from said weight for directionally regulating a damping force associated with movement of said weight through said liquid;

said cable attached to said weight at said first end; and one of said housing and said second end of said cable attached at a fixed location with respect to said door and the other of said housing and said second end of said cable attached to said door;

whereby said weight moves upwardly through said liquid in said elongate passageway with a first damping force in response to an opening movement of said door, and moves downwardly through said liquid in said elongate passageway with a second damping force when said door is released, thereby controlling a rate at which said door automatically closes.

7. The system as claimed in claim 6 in which said first cross-sectional shape is substantially square and in which said second cross-sectional shape is substantially circular.

8. The system as claimed in claim 7 in which said valve member has a cross-sectional shape which is substantially square and provides a tolerance fit with said first cross-sectional shape of said housing, and in which said valve member further includes a plurality of openings provided therethrough, said openings disposed concentrically within said square shaped valve member.

9. The system as claimed in claim 7 further including:

a shaft including a stop portion;

said valve member connected to said weight by said shaft attached to said weight;

said valve member having a mounting hole receiving said shaft and sliding thereon between said weight and said stop portion;

said valve member disposed in a first position against said stop portion in response to an upward movement of said weight through said liquid thereby producing said first damping force;

said valve member disposed in a second position against said weight portion in response to a downward movement of said weight through said liquid thereby producing said second damping force.

10. The system of claim 9 in which said valve openings are substantially unblocked in said first position corresponding to a relatively small magnitude first damping force.

11. The system of claim 9 in which said valve openings are at least partially blocked in said second position corresponding to a relatively large magnitude second damping force, thereby slowing a rate at which said door automatically closes.

12. A system regulating movement of a door, comprising:

a housing having a first cross-sectional shape and including an elongate passageway disposed between a sealed bottom end of the housing and a top opening thereof;

a liquid disposed in said elongate passageway;

a pulley mounted substantially above said top opening;

said pulley having an axle;

a weight adapted to fit in said housing having a second cross-sectional shape that differs substantially from said first cross-sectional shape;

a cable having a first end and a second end, entrained on said pulley;

a valve member mounted to said weight for movement toward and away from said weight for directionally regulating a damping force associated with movement of said weight through said liquid;

said cable attached to said weight at said first end;

one of said housing and said second end of said cable attached at a fixed location with respect to said door and the other of said housing and said second end of said cable attached to said door; and the upper end of said passageway being closed by two mating molded plastic parts, said plastic parts interfitting to form a plug having a reduced portion which extends into said passageway thereby holding said two plastic parts together, and said plug formed of said pair of molded plastic parts having a shoulder which engages the upper end of said passageway, each of said plastic parts having a cylindrical surface therein to form a mounting surface for the axle of said pulley;

whereby said weight moves upwardly through said liquid in said elongate passageway with a first damping force in response to an opening movement of said door, and moves downwardly through said liquid in said elongate passageway with a second damping force when said door is released, thereby controlling a rate at which said door automatically closes.

13. The system as claimed in claim 12 in which said first cross-sectional shape is substantially square and in which said second cross-sectional shape is substantially circular.

14. The system as claimed in claim 13 in which said valve member has a cross-sectional shape which is substantially square and provides a tolerance fit with said first cross-sectional shape of said housing, and in which said valve member further includes a plurality of openings provided therethrough, said openings disposed concentrically within said square shaped valve member.

15. The system as claimed in claim 13 further including:

a shaft including a stop portion;

said valve member connected to said weight by said shaft attached to said weight;

said valve member having a mounting hole receiving said shaft and sliding thereon between said weight and said stop portion;

said valve member disposed in a first position against said stop portion in response to an upward movement of said weight through said liquid thereby producing said first damping force;

said valve member disposed in a second position against said weight portion in response to a downward movement of said weight through said liquid thereby producing said second damping force.

16. The system of claim 15 in which said valve openings are substantially unblocked in said first position corresponding to a relatively small magnitude first damping force.

17. The system of claim 15 in which said valve openings are at least partially blocked in said second position corresponding to a relatively large magnitude second damping force, thereby slowing a rate at which said door automatically closes.

18. The system as defined in claim 12 in which:

said weight further comprises a lead cylinder and includes a bottom surface having a substantially circular perimeter; and said valve member includes a plurality of substantially circular openings each having a respective center substantially aligned with said circular perimeter;

wherein said bottom surface of said weight halts the translational motion of said valve member along said shaft when said weight moves downwardly thereby partially blocking each of said valve openings and providing a relatively large second damping force in opposition to downward movement of said weight and thereby controlling a rate at which said door automatically closes.

19. The device as defined in claim 12 for use with a sliding door, further including housing securing means;

in which said housing is attached on said door by said securing means and said second end of said tension line is attached at a fixed location relative said door.

20. A system as defined in claim 12 for use with a sliding door, further including housing securing means;

in which said second end of said tension line is attached to said door and said housing is attached at a fixed location relative said door by said securing means.

* * * * *